US006315619B1

(12) United States Patent
Nakamura

(10) Patent No.: US 6,315,619 B1
(45) Date of Patent: Nov. 13, 2001

(54) THREE PART ELECTRICAL CONNECTOR WITH PREVENTATION LATCHING MEANS

(75) Inventor: Hideto Nakamura, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 09/556,866

(22) Filed: Apr. 21, 2000

(30) Foreign Application Priority Data

Apr. 22, 1999 (JP) ..... 11-115260

(51) Int. Cl.[7] ..... H01R 13/514
(52) U.S. Cl. ..... 439/701; 439/352
(58) Field of Search ..... 439/701, 352, 439/353, 355

(56) References Cited

U.S. PATENT DOCUMENTS 5,876,252 * 3/1999 Hahn et al. ..... 439/701

FOREIGN PATENT DOCUMENTS 10-229621 8/1998 (JP) .

* cited by examiner

*Primary Examiner*—Paula Bradley
*Assistant Examiner*—Ann McCamey
(74) *Attorney, Agent, or Firm*—Banner & Witcoff, Ltd.

(57) ABSTRACT

The invention prevents a sub-connector housing from being inadvertently separated from a frame. A frame 10 is installed in an attachment hole 2 of a panel 1. When a male sub-housing 20 is pushed from a posterior direction into a housing chamber 13 formed within the frame 10, a protruding member 44 of a locking arm 43 provided on an outer face of a posterior end of the sub-housing 20 latches resiliently against a stopping member 51 of a stopping plate 50 provided on an inner face of the housing chamber 13. A large hood member 33 of a corresponding female housing 30 is fitted with the sub-housing 20 from the anterior thereof, this large hood member 33 covering an outer circumference of a anterior end of the sub-housing 20. A recess 37 is formed at a tip of this large hood member 33. When the two housings 20 and 30 are correctly fitted together, a tip of the locking arm 43 fits into this recess 37. If the two housings 20 and 30 are correctly fitted together, the bending of the locking arm 43 is regulated and the locking arm 43 is maintained in a latched state with the stopping member 51.

11 Claims, 4 Drawing Sheets

THREE PART ELECTRICAL CONNECTOR WITH PREVENTATION LATCHING MEANS

TECHNICAL FIELD

The present invention relates to an electrical connector in which a sub-connector housing is installed inside a frame.

BACKGROUND TO THE INVENTION

A split connector is occasionally used as a multiple connector in order to allow terminal fittings to be inserted correctly into corresponding cavities, or in order to allow conductivity to be tested conveniently, etc. This split connector has a configuration whereby a plurality of housing chambers are partitioned within a frame. Sub-connector housings distributed within cavities are inserted from the posterior into each housing chamber and are housed therein. These sub-connector housings fit, from anterior faces thereof, with a corresponding connector housing.

A means to retain the sub-connector housing in a latched state within the housing chambers is described for example, in JP 10-229621. Outer faces of the sub-connector housings are provided with bendable locking arms, these engaging resiliently with stopping protrusions provided on inner faces of the housing chambers.

However, the latching configuration of the conventional example has the following problem. If, for example, excessive force is used on the sub-connector housings to pull them in a posterior direction, the locking arms may bend excessively and the sub-connector housings may separate from the frame The present invention has taken the above problem into consideration, and aims to present a sub-connector housing which will not be separate inadvertently from the frame.

SUMMARY OF THE INVENTION

According to the invention there is provided an electrical connector comprising a frame, a sub-connector latchable in said frame on a latching axis, and a mating connector latchable with said sub-connector also on said latching axis, the sub-connector having a resilient latching arm protruding in the direction of said latching axis, and bendable transversely of said axis for engagement with a latch member of said frame characterised in that said mating connector includes a recess adapted to receive said latching arm in close fitting engagement on connection of said sub-connector and mating connector, thereby to prevent transverse bending of said latching arm.

This arrangement ensures that the latching arm is immovable once the mating connector has been fitted to the sub-connector. Accordingly, resistance to a high separation force is increased.

Preferably the tip of the latching arm engages in an external groove of a hood of the mating connector. Such a groove can be conveniently formed in a protruding flange of the hood, and does not penetrate the wall of the hood itself.

The frame preferably includes a latching portion for the latching projection, this portion being defined in the preferred embodiment by wall members extending in the direction of said axis.

A protrusion of said wall and a projection of said latch member may define the latch between said sub-connector and frame.

BRIEF DESCRIPTION OF DRAWINGS

Other features of the invention will be apparent from the following description of a preferred embodiment shown by way of example only, in the accompanying drawings in which.

DESCRIPTION OF THE PREFERRED EMBODIMENT

An embodiment of the present invention is described below with the aid of FIGS. 1 to 7.

Figure 1:
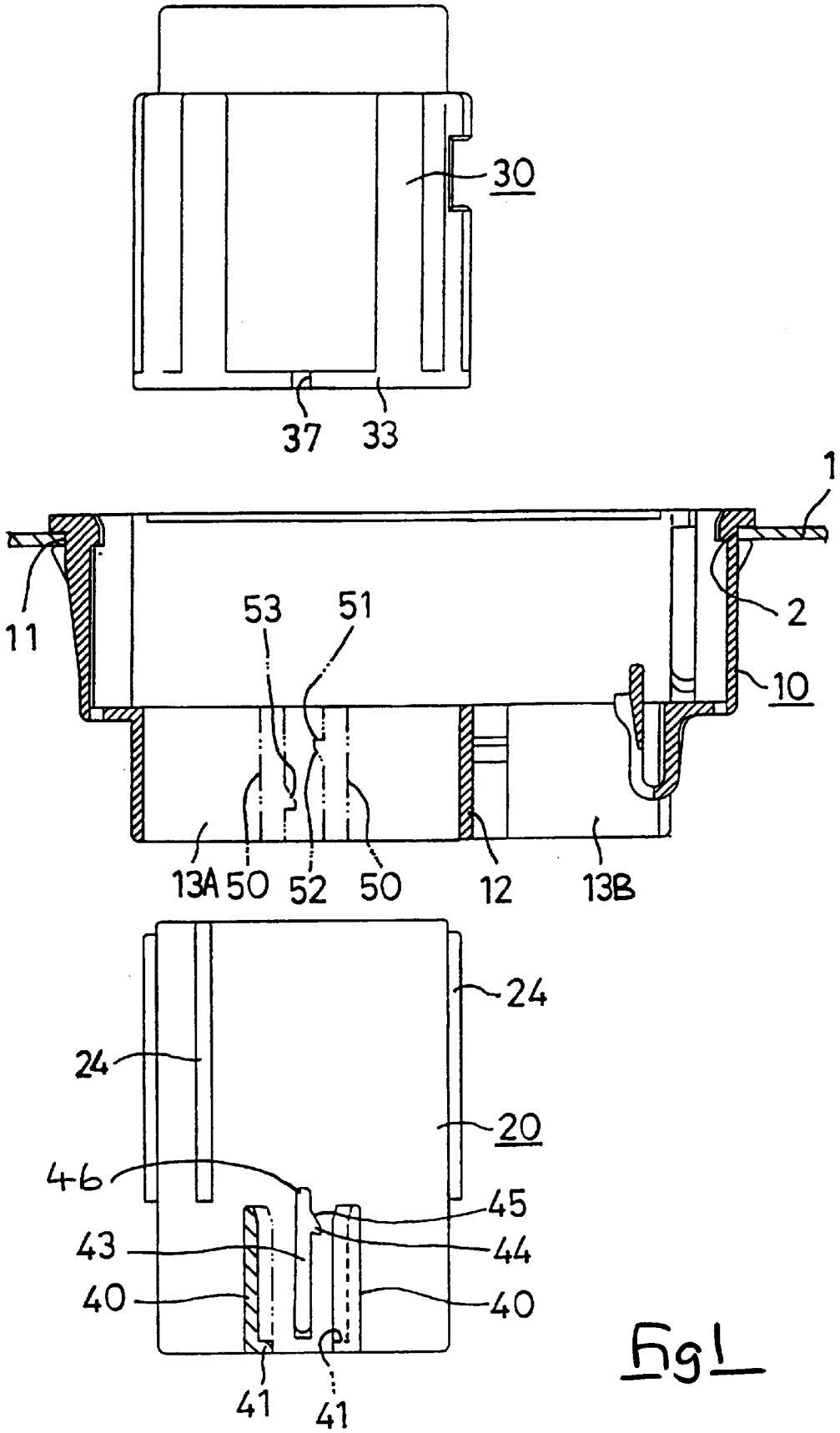
FIG. 1 is a partially cut-away base face view of two housings of a first embodiment prior to being fitted together.

In the present embodiment as shown in FIG. 1, two (only one is shown) male sub-connector housings 20 are housed inside a frame 10, a corresponding female connector housing 30 being fitted individually with each sub-housing 20.

The frame 10 is cylindrical and is stepped so that an anterior face (at the top in FIG. 1) thereof is larger. The frame 10 is inserted from an anterior direction into an attachment hole 2 of a panel 1 attached to a car body or the like. A stopping groove 11 formed on an outer circumference of an anterior edge of the frame 10 fits with a hole edge of the attachment hole 2, thereby attaching the frame 10.

A partitioning wall 12 is formed at a posterior portion within the frame 10, this partitioning wall 12 dividing the frame 10 into left and right housing chambers 13A, 13B.

Figure 2:
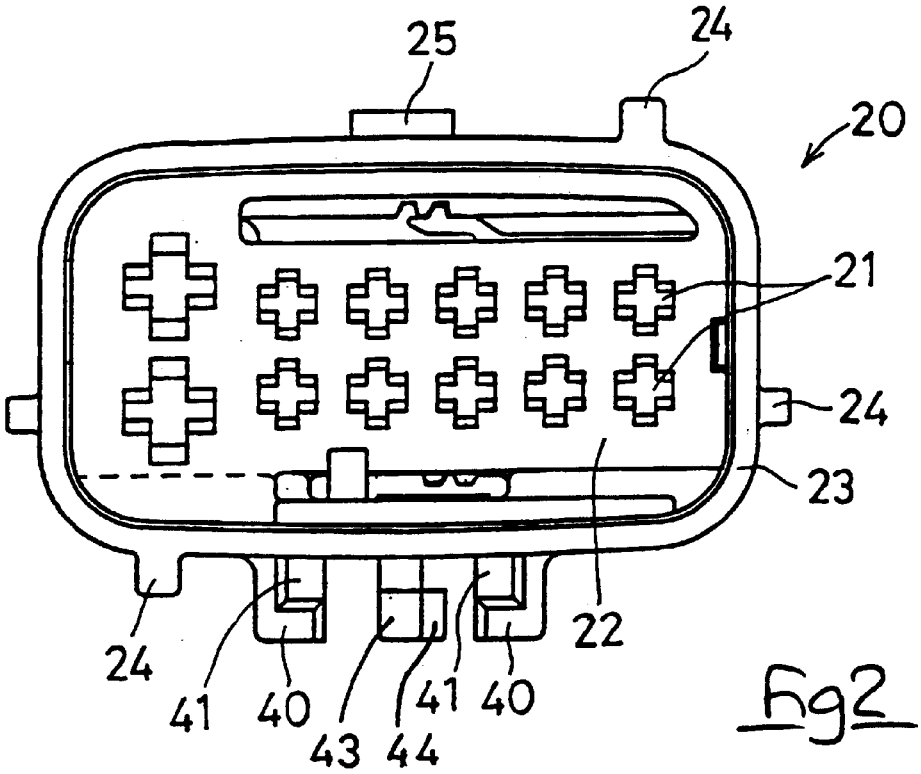
FIG. 2 is a front view of a sub-housing of FIG. 1.

The sub-housing 20 shown in FIG. 2 is housed within the left housing chamber 13A, and has an approximately rectangular cross-sectional shape, the corners thereof being rounded. A plurality of cavities 21 formed in an aligned manner within a terminal housing member 22 form an upper and a lower row. A small hood member 23 is formed on an outer circumference of an anterior face of the terminal housing member 22. A male terminal fitting (not shown) is inserted from a posterior direction into each of the cavities 21. The male terminal fittings are housed in the small hood member 23 so that tabs belonging to the male terminal fittings protrude into the small hood member 23.

Four ribs 24 protrude from an outer circumference of an anterior face of the small hood member 23. The ribs 24 protrude at locations close to diagonally opposing corners on an upper and a lower face of the small hood member 23, and from locations slightly below the centre of left and right side faces of the small hood member 23.

Figure 3:
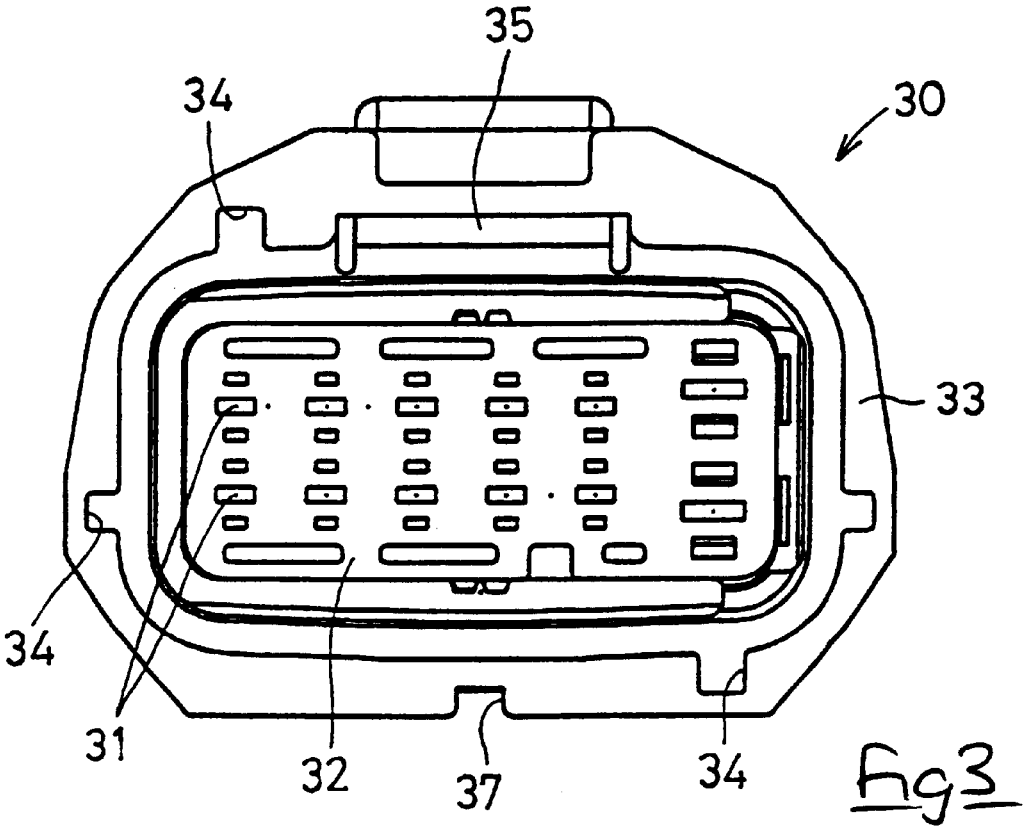
FIG. 3 is a front view of a female housing of FIG. 1.

The female housing 30 which fits with the sub-housing 20 is formed as shown in FIG. 3. The female housing 30 has a terminal housing member 32, and cavities 31 which are mutually aligned therein and which house female terminal fittings (not shown). A large hood member 33 is formed on an outer circumference of an anterior face of the terminal housing member 32, this large hood member 33 being capable of fitting around an outer circumference of the small hood member 23. Guiding grooves 34 are formed in an inner circumference of an anterior face of the large hood member 33. The guiding grooves 34 are capable of fitting with the respective ribs 24 of the small hood member 23.

Furthermore, a stopping arm 35 is provided on an upper face of the female housing 30. When the two housings 20 and 30 have been correctly fitted together, this stopping arm 35 engages resiliently against a stopping protrusion 25 of the sub-housing 20.

The locking configuration of the housing chamber 13, 13A and the sub-housing 20 is described below.

A left and right pair of guiding rails 40, separated by a specified distance, are provided on a lower face of a posterior end of the sub-housing 20 at a central portion thereof in a width-wise direction. As shown in FIG. 2, the guiding rails 40 are cross-sectionally hook shaped and mutually face one another, a protrusion 41 being formed on a posterior end of each guiding rail 40. When the two housings 20 and 30 have been correctly fitted together, a tip of the large hood member 33 reaches a location immediately in front of the guiding rails 40 (see FIG. 7).

A locking arm 43 is formed between the two guiding rails 40. This locking arm 43 rises upwards from its posterior end (as viewed) and protrudes in an anterior direction. The tip of the locking arm 43 protrudes a prescribed distance relative to anterior ends of the guiding rails 40. A protruding member 44 is formed on a side face (the right face in FIG. 1) of the locking arm 43 at a location close to the tip 46 thereof. An anterior face of the protruding member 44 forms a tapered guiding face 45.

Figure 4:
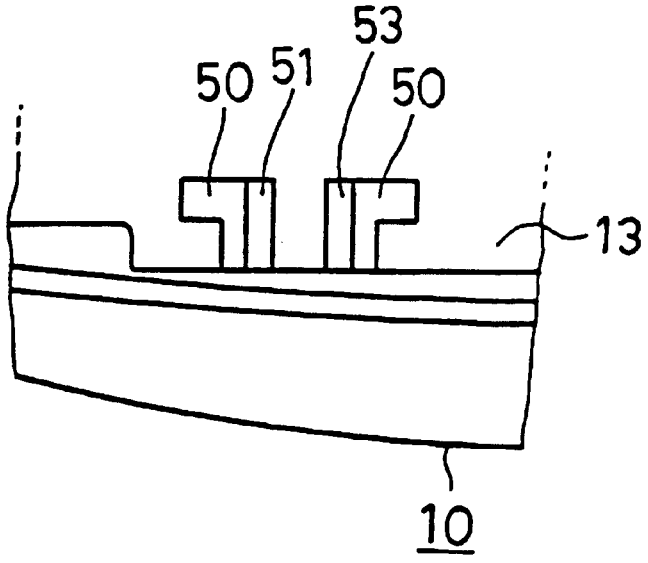
FIG. 4 is a partially expanded front view showing components of a stopping plate.

A pair of stopping plates 50 protrude upwards from base face of a posterior end of the housing chamber 13. As shown in FIG. 4, these stopping plates 50 are cross-sectionally hook shaped and are positioned back to back. The stopping plates 50 are capable of being inserted into the interior of the guiding rails 40. The length of the stopping plates 50 is shorter than the length of the guiding rails 40 to the extent of the thickness of the protrusion 41.

A stopping member 51 is formed on an inner face of one of the stopping plates 50 (the stopping plate 50 on the right in FIG. 1) at a location close to an anterior end thereof. The stopping member 51 is capable of being engaged against the protruding member 44 of the locking arm 43. A posterior face of the stopping member 51 forms a tapered face 52 which is used for guiding the protruding member 44.

An auxiliary stopping member 53 is formed symmetrically on an inner face of the other stopping plate 50 at a location close to a posterior end thereof. When the sub-housing 20 provided with the locking arm 43 is inserted in the housing chamber 13A from the anterior direction, the auxiliary stepping member 53 engages with the arm 43.

A recess 37 is formed in the tip of the large hood member 33 of the female housing 30. This recess 37 is formed by cutting away a part of a lower face of a central portion, in a width-wise direction, of the large hood member 33. The tip of the locking arm 43 is capable of fitting into this recess 37.

The assembly of the present embodiment is described below. Firstly, the frame 10 is attached to the attachment hole 2 of the panel 1 as described above. Next, the sub-housing 20 is inserted into the housing chamber 13 of the frame 10 from the posterior face thereof.

When the posterior end of the sub-housing 20 approaches a posterior edge of the frame 10, the stopping plates 50 of the frame 10 approach tips of the guiding rails 40 of the sub-housing 20. Then, the stopping plates 50 enter between the two guiding rails 40 and the sub-housing 20 is pushed in.

Figure 5:
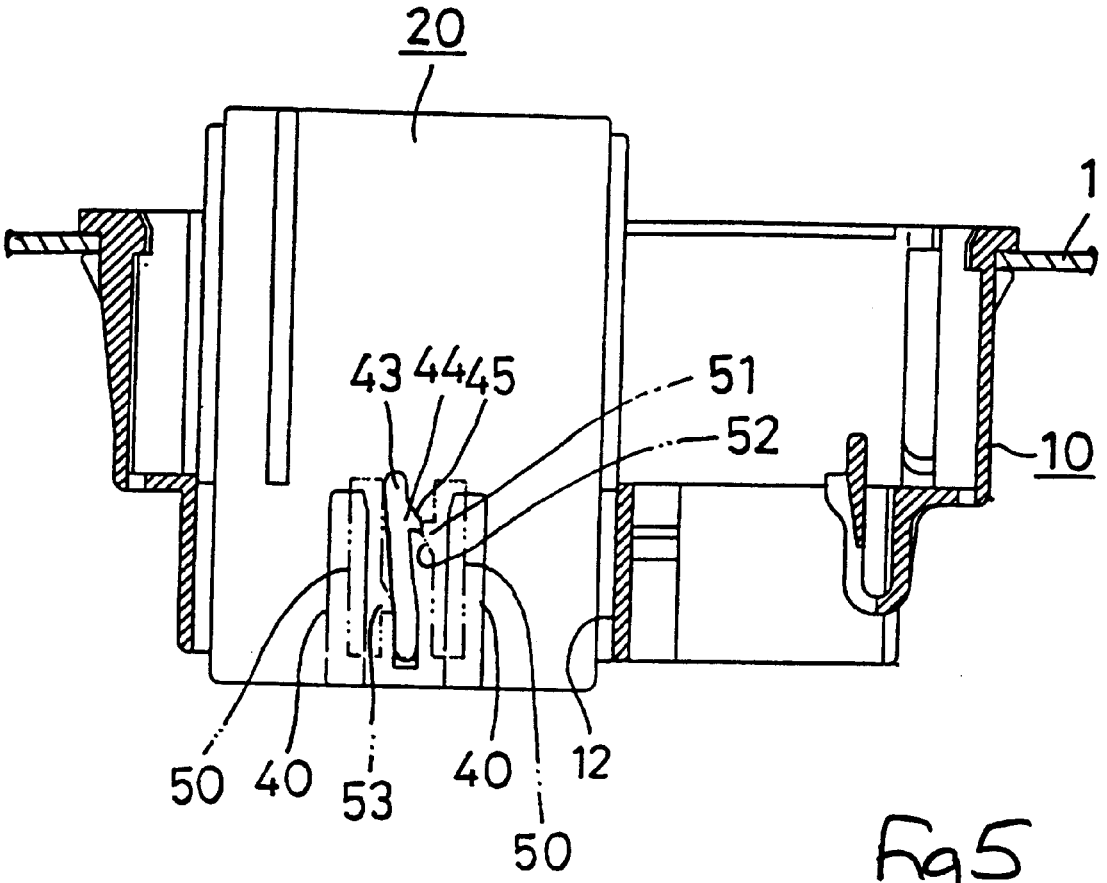
FIG. 5 is a partially cut-away base face view showing the sub-housing being installed in a frame.
Figure 6:
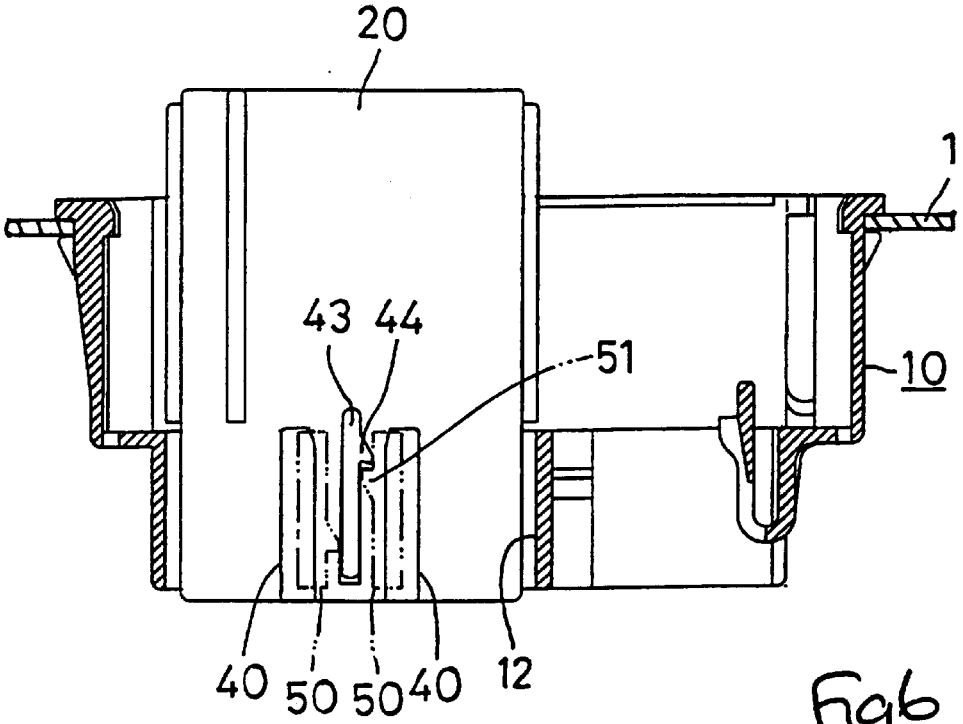
FIG. 6 is a partially cut-away base face view showing the sub-housing in an installed state in the frame.

While this pushing-in is occurring, the protruding member 44 of the locking arm 43 makes contact with the stopping member 51 and, as shown in FIG. 5, the locking arm 43 bends to the left (relative to FIG. 5) as it is pushed in, the tapered faces 45 and 52 serving as guides and the auxiliary stopping member 53 serving as the centre. This pushing-in of the sub-housing 20 stops when the protrusions 41 of the guiding rails 40 make contact with the stopping plates 50. At this juncture, as shown in FIG. 6, the protruding member 44 of the locking arm 43 has passed beyond the stopping member 51 and reverts to its original straight condition, and a posterior face of the protruding member 44 is engaged against the stopping member 51. In this manner, the sub-housing 20 is housed within the housing chamber 13 in a state whereby it cannot move in an anterior or posterior direction.

Next, the sub-housing 20 is fitted from an anterior direction with the corresponding female housing 30. At this juncture, the ribs 24 enter into the corresponding guiding grooves 34, and the large hood member 33 of the female housing 30 fits with the small hood member 23 of the sub-housing 20, this large hood member 33 covering the outer side of the small hood member 23. Opposing faces of the terminal housing members 22 and 32 make mutual contact and are pushed in to the correct position. Thereupon, the stopping arm 35 of the female housing 30 engages resiliently against the stopping protrusion 25 of the sub-housing 20, and the two housings 20 and 30 are latched in a fitted state.

Figure 7:
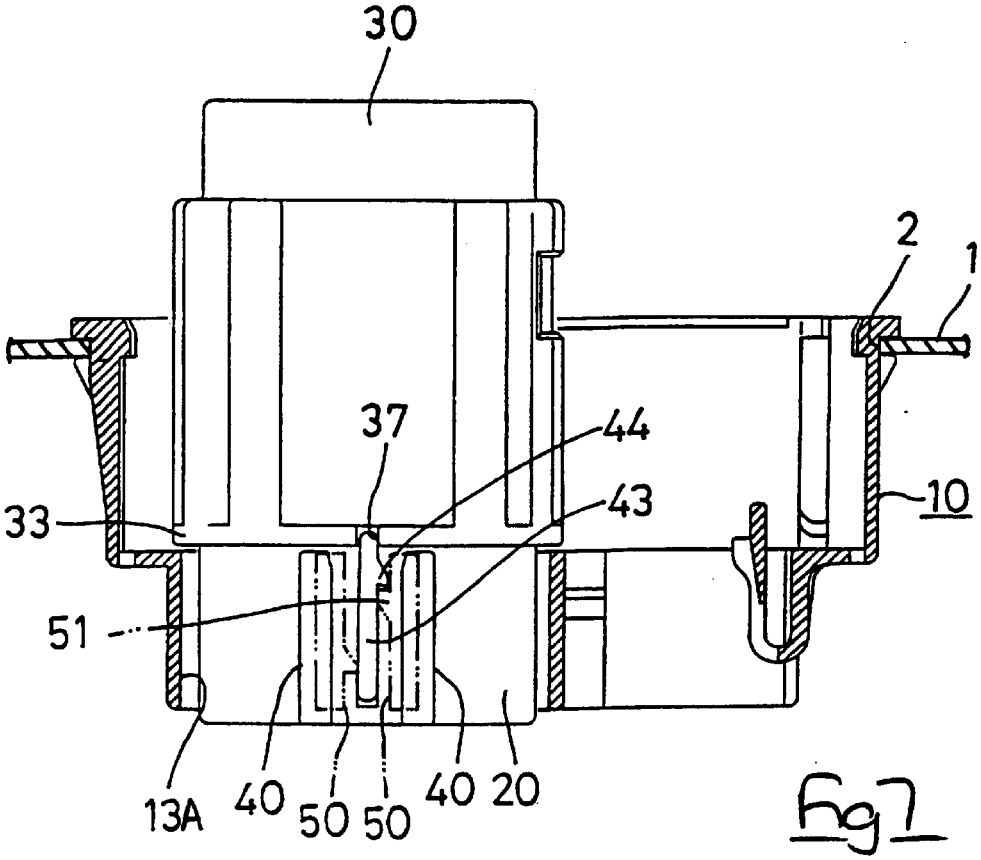
FIG. 7 is a partially cut-away base face view showing the two housings in a fitted state.

In addition, as shown in FIG. 7, the tip of the locking arm 43 of the sub-housing 20 fits with the recess 37 formed in the large hood member 33 of the female housing 30. As a result, the bending of the locking arm 43 is regulated even if a strong pulling force is exerted in a posterior direction on the female housing 30, the locking arm 43 maintains a retained state with the stopping member 51, and the sub-housing 20 will not separate from the housing chamber 13 of the frame 10.

Moreover, if the sub-housing 20 needs to be separated from the frame 10 for maintenance or the like, the corresponding female housing 30 is first separated from the sub-housing 20. When this is done, the locking arm 43 becomes capable of bending, a jig is inserted from an anterior direction into the tip of the locking arm 43, and the locking arm 43 is bent, thereby releasing it from the stopping member 51. Thereupon the sub-housing 20 is pushed from the anterior direction, separating it from the housing chamber 13.

According to the embodiment described above, if the corresponding female housing 30 is fitted correctly with the sub-housing 20, the tip of the locking arm 43 will fit with the recess 37 of the large hood member 33 of the female housing 30, thereby regulating the bending of the locking arm 43 and maintaining it in a latched state with the topping member 51. Consequently, inadvertent separation of the sub-housing 20 from the frame 10 is prevented.

Moreover, providing the large hood member 33 of the female housing 30 with the recess 37, which enables the tip of the locking arm 43 to fit therein, is a simple configuration which allows the female housing 30 and the locking arm 43 to interlock. Furthermore, the present invention is not limited to the embodiments described above with the aid of figures. The present invention may be embodied in various other ways without deviating from the scope thereof.

What is claimed is:

1. An electrical connector comprising a frame, a sub-connector latchable in said frame on a latching axis, and a mating connector latchable with said sub-connector also on said latching axis, the sub-connector having a resilient latching arm extending in the direction of said latching axis, and bendable transversely of said axis for engagement with a latch member of said frame, wherein said mating connector includes a recess located to receive said latching arm in close fitting engagement on connection of said sub-connector and mating connector, to thereby prevent transverse bending of said latching arm.

2. A connector according to claim 1 wherein said latching arm includes a tip for engagement in said recess and a transverse latching projection inboard of said tip.

3. A connector according to claim 2 wherein said projection has a taper on a side adjacent said tip.

4. A connector according to claim 2 wherein said latching projection of said latching arm is adjacent said tip.

5. A connector according to claim 4 wherein said projection has a taper on a side adjacent said tip.

6. A connector according to claim 1 wherein said frame includes a latching portion adapted to receive said latching arm.

7. A connector according to claim 6 wherein said latching portion is defined by substantially parallel wall members extending in the direction of said axis, said wall members each having a protrusion extending into a path defined by said wall members in which said latching arm is received.

8. A connector according to claim 7 wherein said projection and one of said protrusions define a latch between said frame and sub-connector.

9. A connector as claimed in claim 8 wherein said protrusions define a main latch adapted to engage said latching arm in a first direction along said latching axis, and an auxiliary latch adapted to engage said latching arm in a direction opposite to the first direction along said latching axis.

10. A connector according to claim 1 wherein said mating connector includes a hood adapted to encircle said sub-connector, said recess being provided in the outer wall of said hood.

11. A connector according to claim 2 wherein said latching arm includes a tip for engagement in said recess and a transverse latching projection inboard of said tip.

* * * * *